US006969156B2

(12) United States Patent
Beurer et al.

(10) Patent No.: US 6,969,156 B2
(45) Date of Patent: Nov. 29, 2005

(54) DROPLET GENERATOR FOR MICRODROPLETS, IN PARTICULAR NOZZLE HEAD FOR INKJET PRINTER

(75) Inventors: Gerhard Beurer, Ulm (DE); Thomas Franke, Ulm (DE); Gerhard Schmidt, Ulm (DE); Johann Stempfle, Pfaffenhofen (DE)

(73) Assignee: Tally Computer Drucker GmbH, Elchingen (DE)

( * ) Notice: Subject to any disclaimer, the term of this patent is extended or adjusted under 35 U.S.C. 154(b) by 41 days.

(21) Appl. No.: 10/217,257

(22) Filed: Aug. 12, 2002

(65) Prior Publication Data

US 2003/0090549 A1 May 15, 2003

(30) Foreign Application Priority Data

Aug. 10, 2001 (DE) ..... 101 39 397

(51) Int. Cl.[7] ..... B41J 2/045
(52) U.S. Cl. ..... 347/68; 347/71
(58) Field of Search ..... 347/69–72, 54

(56) References Cited

U.S. PATENT DOCUMENTS 6,254,223 B1 * 7/2001 Kim et al. ..... 347/70
6,382,780 B1 * 5/2002 Watanabe et al. ..... 347/68
6,500,354 B1 * 12/2002 Lee et al. ..... 216/27
6,783,214 B2 * 8/2004 Sakuma ..... 347/72

FOREIGN PATENT DOCUMENTS

| | | |
|---|---|---|
| DE | 3317082 | 11/1984 |
| EP | 0713773 | 5/1996 |
| EP | 0993951 | 4/2000 |

* cited by examiner

*Primary Examiner*—Stephen D. Meier
*Assistant Examiner*—An H. Do
(74) *Attorney, Agent, or Firm*—Horst M. Kasper

(57) ABSTRACT

A droplet generator for microdroplets (6), in particular a nozzle head for inkjet printers, having groups of piezo electrically actuated bending converters (1) disposed in a casing (11), wherein the bending converters (1) are disposed at a distance from each other and are guided in recesses separated by wall thicknesses, wherein liquid longitudinal channels (12) run below the flexible fingers (5) and having a liquid chamber (13) with a nozzle (7), can maintain a high liquid flow, in the case of sufficiently thick chamber walls, wherein the chamber walls do not allow a deformation to occur having in each case an edge bead (15) run around an opening (14) of the liquid chamber (13), wherein the edge bead (15) serves to limit a stroke of a respective one of the flexible fingers (5) and wherein a shaft (16) having at least the width of the flexible finger (5) and the height level of the base plate (1*a*) follows the opening (14).

21 Claims, 7 Drawing Sheets

DROPLET GENERATOR FOR MICRODROPLETS, IN PARTICULAR NOZZLE HEAD FOR INKJET PRINTER

BACKGROUND OF THE INVENTION

1. Field of the Invention

The invention relates to a droplet generator for microdroplets, in particular for nozzle head for inkjet printers, with groups of piezo electrically actuable bending converters disposed in a casing, wherein the bending converters are sideways guided in recesses and are separated at a distance from each other on a part length of the bending converters by way of wall thicknesses, wherein liquid longitudinal channels are disposed under flexible fingers running in longitudinal direction in the frame plate and wherein a liquid chamber is formed in the base plate, wherein at least one nozzle for each bending converter joins into the liquid chamber.

2. Brief Description of the Background of the Invention Including Prior Art

The initially designated droplet generator is known from the European printed Patent document EP 0713773 A2. However, the conventional construction employs separating walls over a full length and a full height with corresponding wall thicknesses between the parallel next to each other disposed bending converters. Therefore, one has to start with the microdroplets generator for an inkjet printer, with a piezo electric bending converter in a casing, with a bending comb, wherein the rearward passive region of the bending comb is furnished with a cross running connection barrier and wherein the front active region of the bending comb comprises bending tongues, wherein the bending tongues are coordinated to the nozzles, wherein the bending converter comprises a carrier layer and a connected piezo electric layer and exhibits a step section next to a bore hole for a pin at the lower side of the bending converter in the passive section of the carrier layer such that a protruding support section is formed. This construction serves the goal that interferences are avoided in the formation of liquid droplets of a predetermined size and a predetermined time to be maintained, at a discharge angle and in the frequency of the bending converters for avoiding the so-called cross-talk of bending converter chamber to bending converter chamber in a front region disposed toward the nozzles, which front region allows sideways liquid pressure waves.

SUMMARY OF THE INVENTION

1. Purposes of the Invention

It is an object of the present invention to avoid cross talk between individual chambers without expensive and difficult to control placing of separating walls between the flexible fingers, wherein each chamber contains a bending converter, wherein the bending tongue of the bending converter swings out against the corresponding nozzle in the common base plate, in order to obtain a high liquid flow with sufficiently thick chamber walls, and in a micrometer region mastered in the production for furnishing a dense mounting of nozzles.

These and other objects and advantages of the present invention will become from the description which follows.

2. Brief Description of the Invention

The present invention provides and the object is accomplished according to the present invention by furnishing an edge bead or a ring bead running in each case around an opening of the liquid chamber, wherein the edge bead serves as the stroke limit for the flexible finger and wherein a shaft having at least the width of the flexible finger and running in its height up to the base plate joins to the opening. The large liquid inlet at the liquid chamber accomplished thereby effects a more efficient fluid stream. This fluid stream reduces the pressures on the surrounding walls. Undesirably high-pressure waves are being avoided. Upon employment of the full flow width, one has to expect only a small flow resistance. Since the walls sealingly close in downward direction, the problem is not generated to master production tolerances in the micrometer region. A particular improvement is accomplished with the edge bead: the fluid stream can be sheared off and the liquid volume is thereby sharply limited. The inner space is sealed off upon placing the bead to the lower edge of the bending converter. Further advantages are thereby obtained in case of variations of pressure and temperature. The resting flexible finger represents therewith a sealing such that no liquid can exit caused by pressure and temperature variations.

The feed of liquid is further supported according to a specific embodiment, wherein a common liquid inlet is disposed in the casing above the group of flexible fingers.

The liquid feed is furthermore improved by having the liquid longitudinal channels under the flexible fingers connected to a fluid feed line running cross (mostly perpendicular) to the flexible fingers in a region disposed away from the nozzles.

It can be advantageous depending on the exit direction of the liquid droplets that the liquid chamber in the frame plate is continued below the edge bead with the width of the (input-) opening and extends at a right angle up to the opening of the nozzle.

One embodiment further furnishes that the nozzles are disposed in a nozzle plate placed onto the casing and/or the frame plate and/or the base plate.

The exit direction of the liquid droplets is for example taken into consideration by disposing the nozzle plate at the inner side of the base plate while the nozzles are running perpendicular through the base plate.

It is furnished according to another further embodiment that in each case a separating web line in the frame plate runs at the edge bead. This reduces the pressure spreading and the cross talk to the neighboring chamber up to the region of small flexible finger deflections.

Here the separating web can in each case be connected between two next to each other running edge beads.

In order to prevent that the flexible finger impinges onto the edge bead and a break damages is generated, it is advantageous that in each case a protruding roll off face is furnished between two neighboring separating webs reaching between the separating webs and aligned opposite to the separating webs. Here the edge bead, the separating web, the bearing position and the roll off face are disposed in one plane. Furthermore the damping behavior of the flexible finger can thereby be adapted to the fluid. It is also advantageous that the faces around the edge bead and the roll off plane are deepened up to the separating webs.

A further embodiment comprises that a saw slot is incorporated between in each case two flexible fingers formed by a saw cut during production, wherein the saw slot corresponds in its width to the thickness of an chamber intermediate wall or to the thickness of a separating web.

Embodiment examples of the invention are illustrated in the drawing and are explained in more detail in the following.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
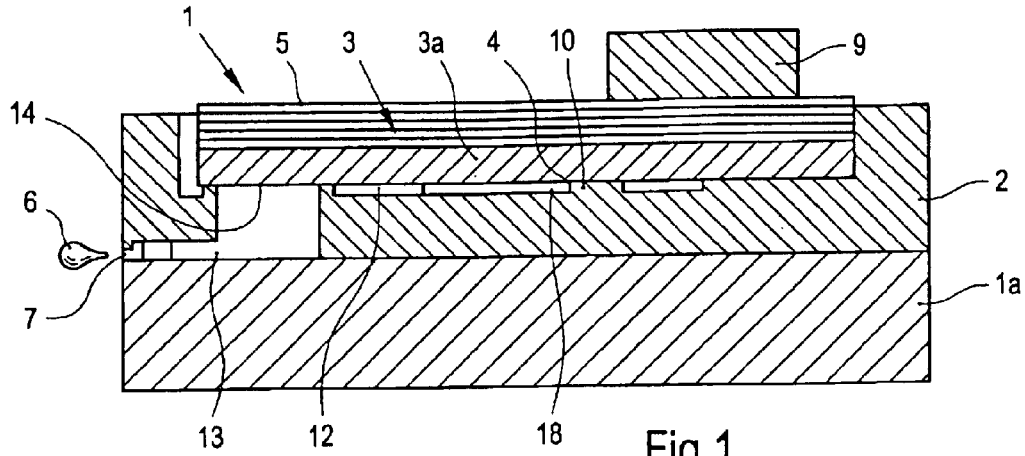
FIG. 1. A longitudinal sectional view through the bending converter with base plate, frame plate, liquid chamber and nozzle, FIG. 2. the same section as in FIG. 1 together with a casing, FIG. 3. the same section with a formed on nozzle, FIG. 4A. a partial sectional view in the direction of the nozzles with liquid chamber and separating webs, FIG. 4B. a partial sectional view in the direction of the nozzles in the plane, wherein the liquid can pass into a neighboring liquid chamber, FIG. 4C. a partial sectional view in the direction of the nozzles upon resting of the flexible fingers on the liquid chamber, FIG. 5A. a top planar view onto the frame plate with the separating webs, FIG. 5B. a sectional view through the embodiment of FIG. 5A in the plane of the liquid chamber, and FIG. 6. a top planar view onto the frame plate and the roll off faces.

The droplets generator exhibits several in a row disposed bending converters 1, wherein the bending converters are formed in each case out of a piezo plate 3 adhesively attached to a frame plate 2. The piezo plate 3 adhesively attached to the frame plate 2 are separated in the following by sawing into individual bending converters 1, depending on the distance between two nozzles 7. The frame plate 2 is furnished with regions for fixing of the piezo plate 3, in which the regions form a bearing edge 4, a flexible finger 5, and other regions, wherein the flexible fingers 5 accelerat-ingly move into a released position from a pre-tensioned position in order to allow a liquid droplet 6 to exit through a nozzle 7 in each case. Also a bending comb can be employed where the piezo plate 3 is furnished with a connection barrier 9 (FIG. 1). In the following, the individual flexible fingers 5 are produced by sawing. From this, the frame plate 2 furnished with cutouts, steps, projections, and edges (so-called structures) is placed onto the individual bending fingers 5 instead of a planar, bimorphous multi-layer piezo plate 3*a* (passive construction kind—in contrast to the multi-layer piezo plate 3*b* in active construction kind). The connection barrier 9 is aligned, centered, and fixed, for example, by means of adhesively attaching or clamping. The adhesive attachment face for the bending converter 1 amounts to approximately one-third of its total length. An alignment effect toward the freestanding flexible finger 5 results from this.

The frame plate 2 exhibits the bearing position 10 for the bending converter 1 as well as auxiliary means for aligning the group subdivided into individual bending converters 1. A casing 11 sealingly surrounds the group of the bending converters 1.

Longitudinally running liquid longitudinal channels 12 are disposed in the frame plate 2 below the flexible finger 5, wherein the liquid longitudinal channels 12 end in a liquid chamber 13 found in the base plate 1*a*. Each liquid chamber 13 exhibits at least one nozzle 7.

Figure 2:
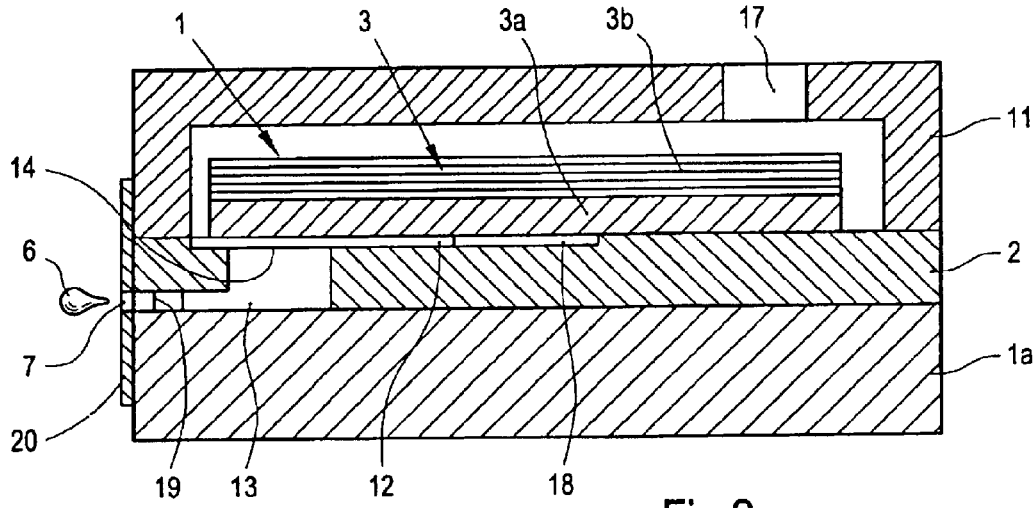
Figure 3:
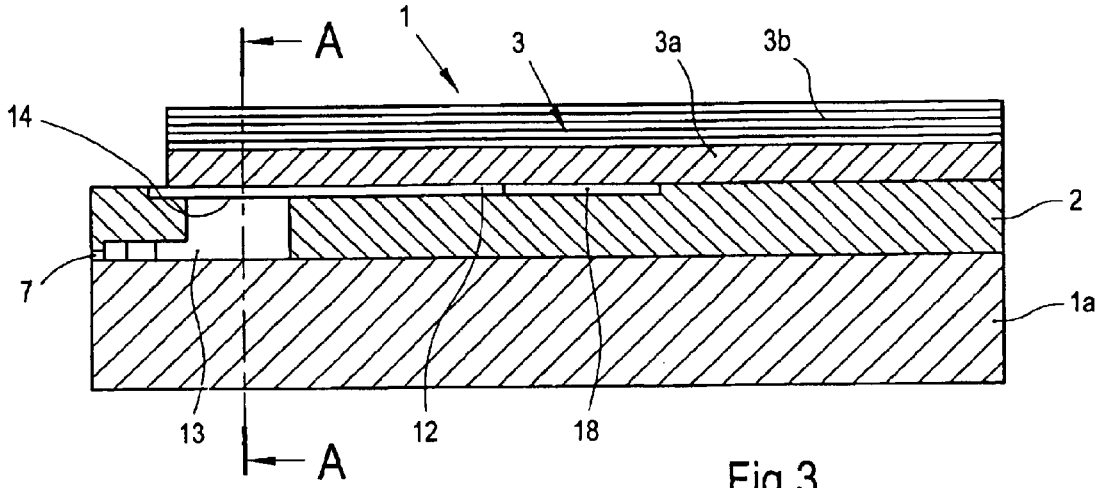

Amongst others, an opening 14 influences the feed of liquid. The opening 14 has the largest possible square (or rectangular) cross-section, which cross-section results in the constructive measurements between the flexible fingers 5 and the nozzle distances. An edge bead or peripheral edge portion 15 runs from the opening 14 of the liquid chamber 13, at which the edge bead 15 is disposed in the region of the largest reflection of the flexible finger 5, and wherein the edge bead 15 consequently serves as a stroke limitation for the flexible finger 5. The shaft 16 having at least the width of the flexible finger 5 and reaching in its height up to the base plate 1*a* follows to the opening 14. The chamber 13 is led up to the nozzle 7 without substantial narrowing. The fluid stream is deflected with the front side droplets exiting (FIGS. 1–3).

The liquid chamber 13 serves initially for the feeding of liquid into all nozzle stations and the shaft 16 can be considered as an inlet port for liquid coming from the liquid chamber 13. The shaft 16 and the liquid chamber 13 have a different function, wherein in particular the shaft assumes the task to define an overflow edge with the edge bead 15.

A sufficiently large volume of liquid is, in principal, furnished by disposing (FIG. 2) a common liquid inlet 17 in the casing 11 above the group of flexible fingers 5. In addition, the liquid longitudinal channels 12 under the flexible fingers 5 are connected to a fluid feed line 18, running cross or perpendicular to the flexible fingers 5 inner region disposed away from the nozzles 7.

The liquid chamber 13 in the frame plate 2 continues with the width 14*a* below the edge bead 15 and extends in the embodiment of FIG. 2 at a right angle up to the outlet 19 of the nozzle 7.

The nozzle 7 can be disposed in a nozzle plate 20, placed onto the casing 11, and/or the frame plate 2 and/or the base plate 1*a*.

The nozzle plate 20 is disposed at the bottom side of the base plate 1*a* when the nozzles 7 are running perpendicular through the base plate 1*a*. This allows optimizing the nozzle geometry without limitations.

Figure 4A:
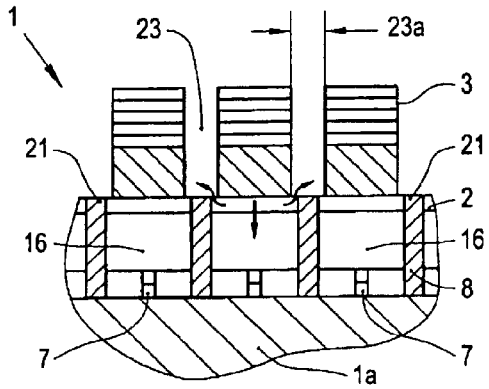
Figure 4B:
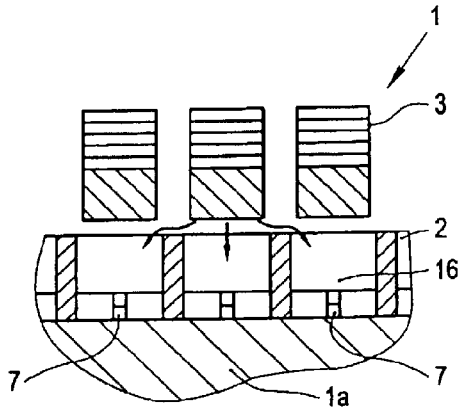
Figure 4C:
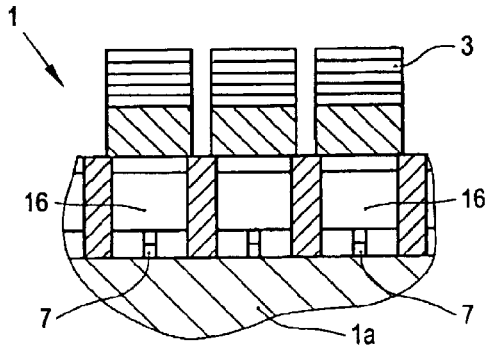

In each case, a separating web 21 runs in the frame plate 2, furthermore at the edge bead 15. The deep shaft 16 (FIGS. 4 through 6) is separated by these webs 21 from each other. A large part of the liquid is pressed sideways to a neighboring bending converter 1 (compare figure 4B) in case there are small nozzle openings disposed immediately below the flexible finger 5. The placement of a pushpin, at the tip of the flexible finger 5 increases the introduction of force without interfering with the after flow of liquid.

Figure 5A:
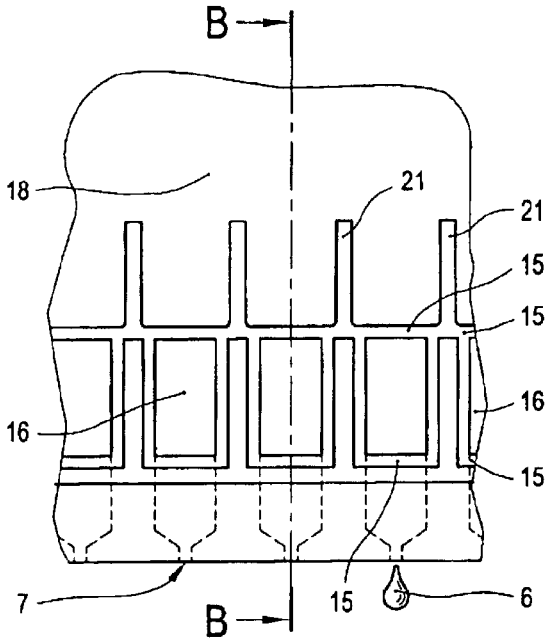
Figure 5B:
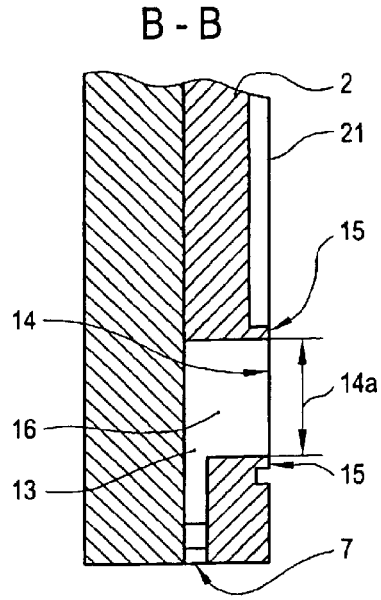
Figure 6:
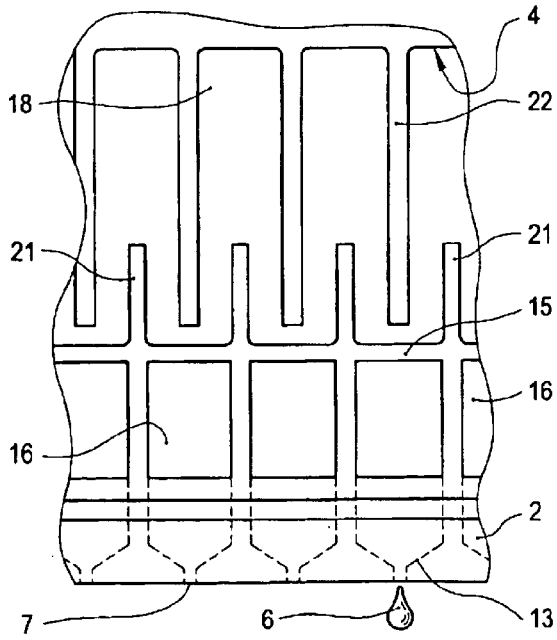
Figure 7:
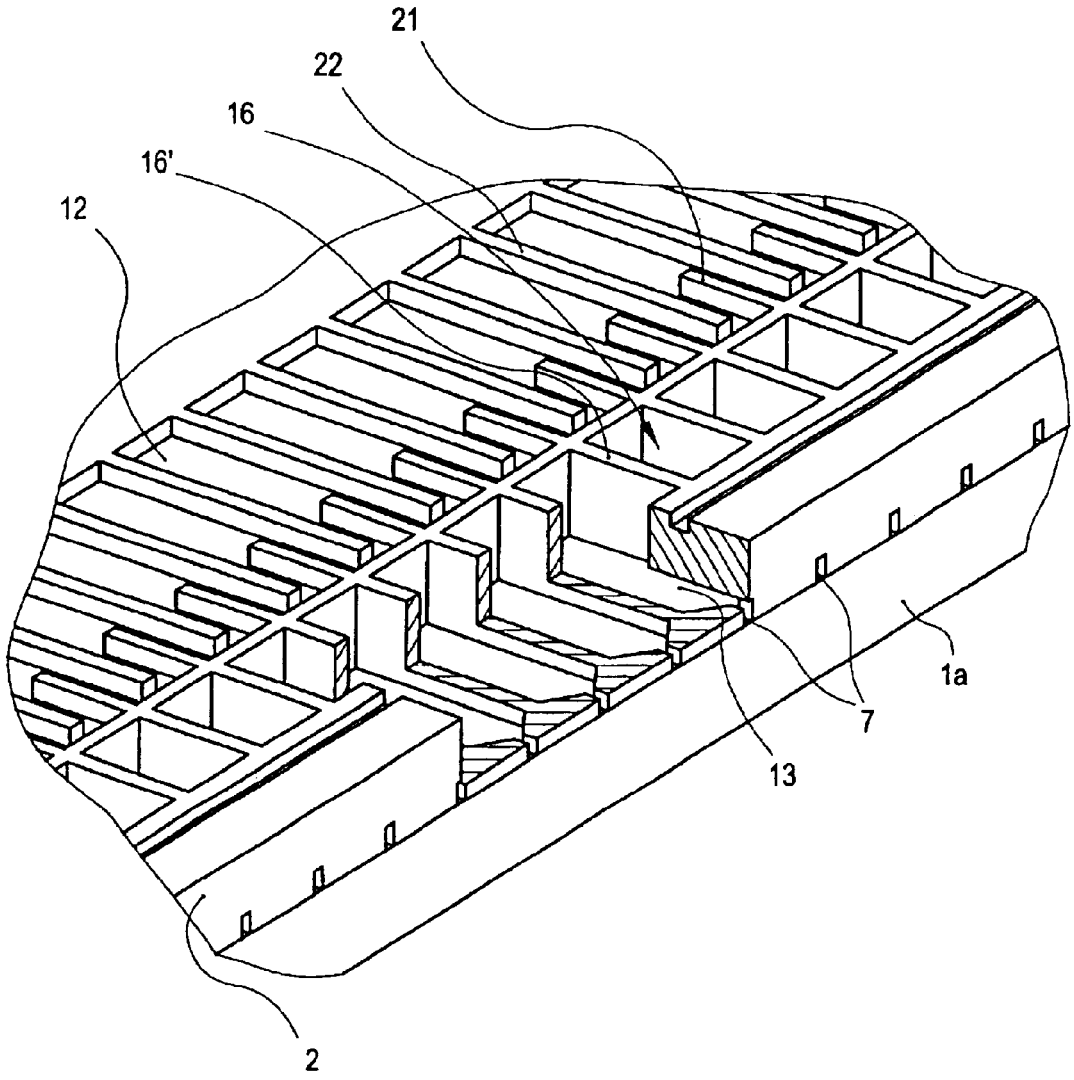
FIG. 7. a perspective view showing a shaft (16) and an associated liquid chamber (13), FIG. 8. a sectional view with the deflected flexible bending finger (5), FIG. 9. a sectional view with the flexible bending finger (5) in the rest position laying on the edge bead (15), FIG. 10. a perspective view with two separated fingers of a piezo-plate (3) disposed above the frame plate, as well as with a non-separated piezo-plate disposed above the frame plate, FIG. 11. a perspective view of the frame plate (2) with these sections.
Figure 8:
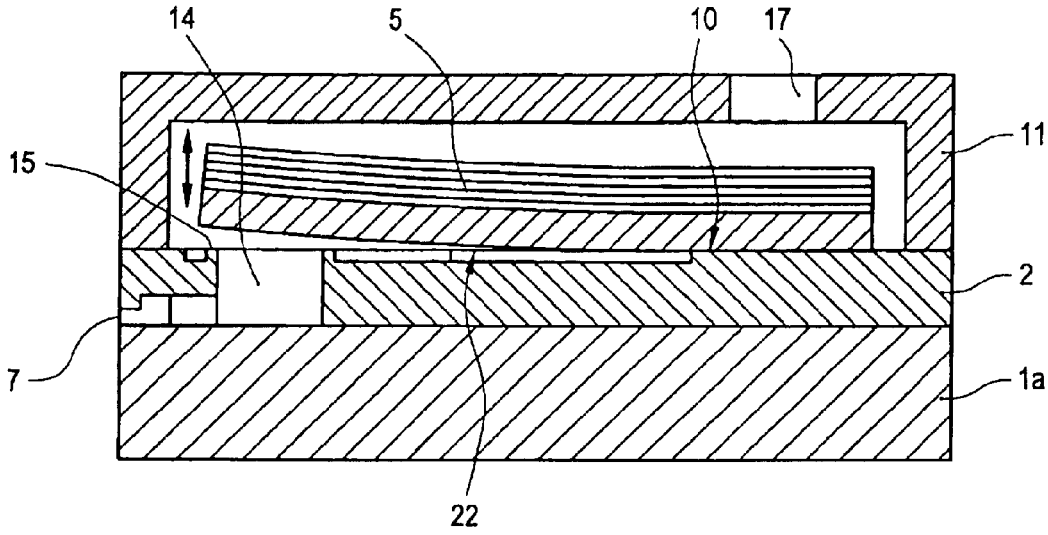
Figure 9:
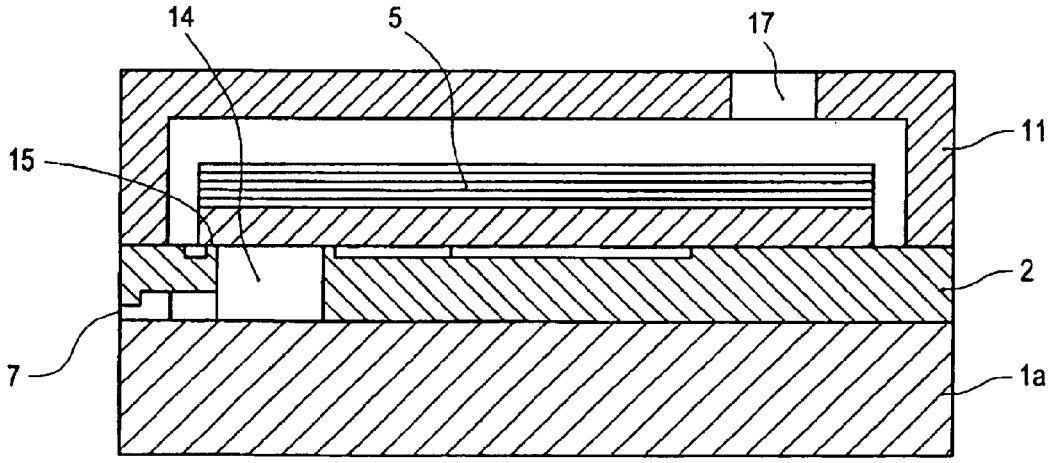
Figure 10:
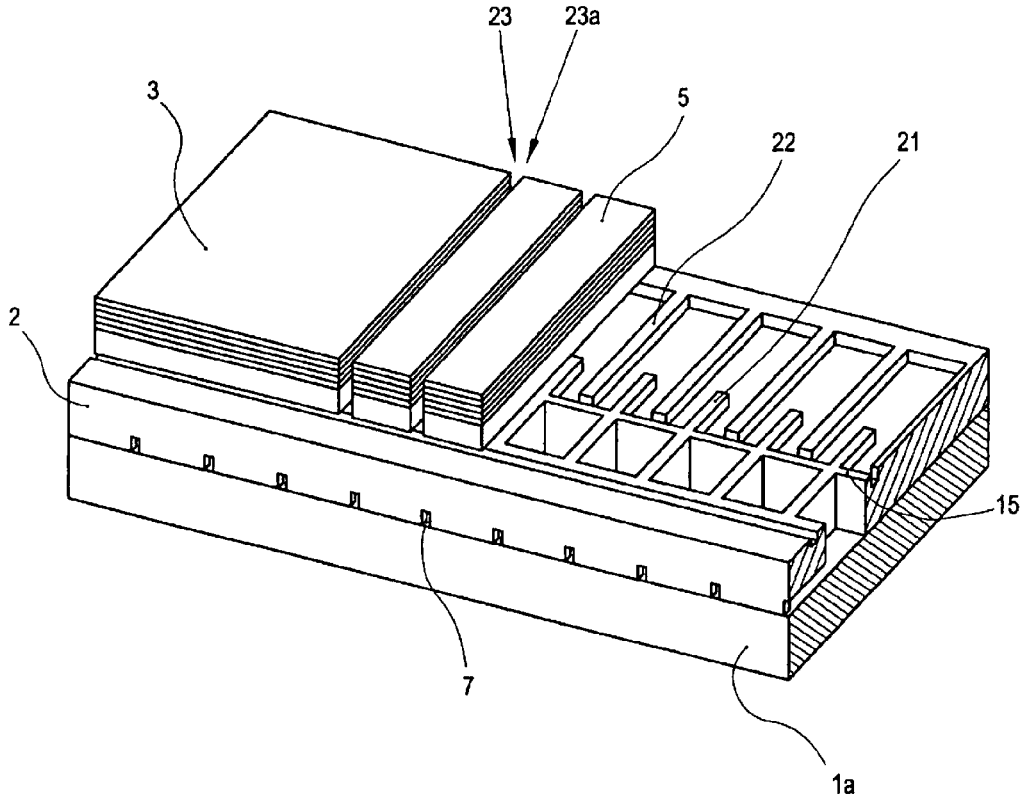
Figure 11:
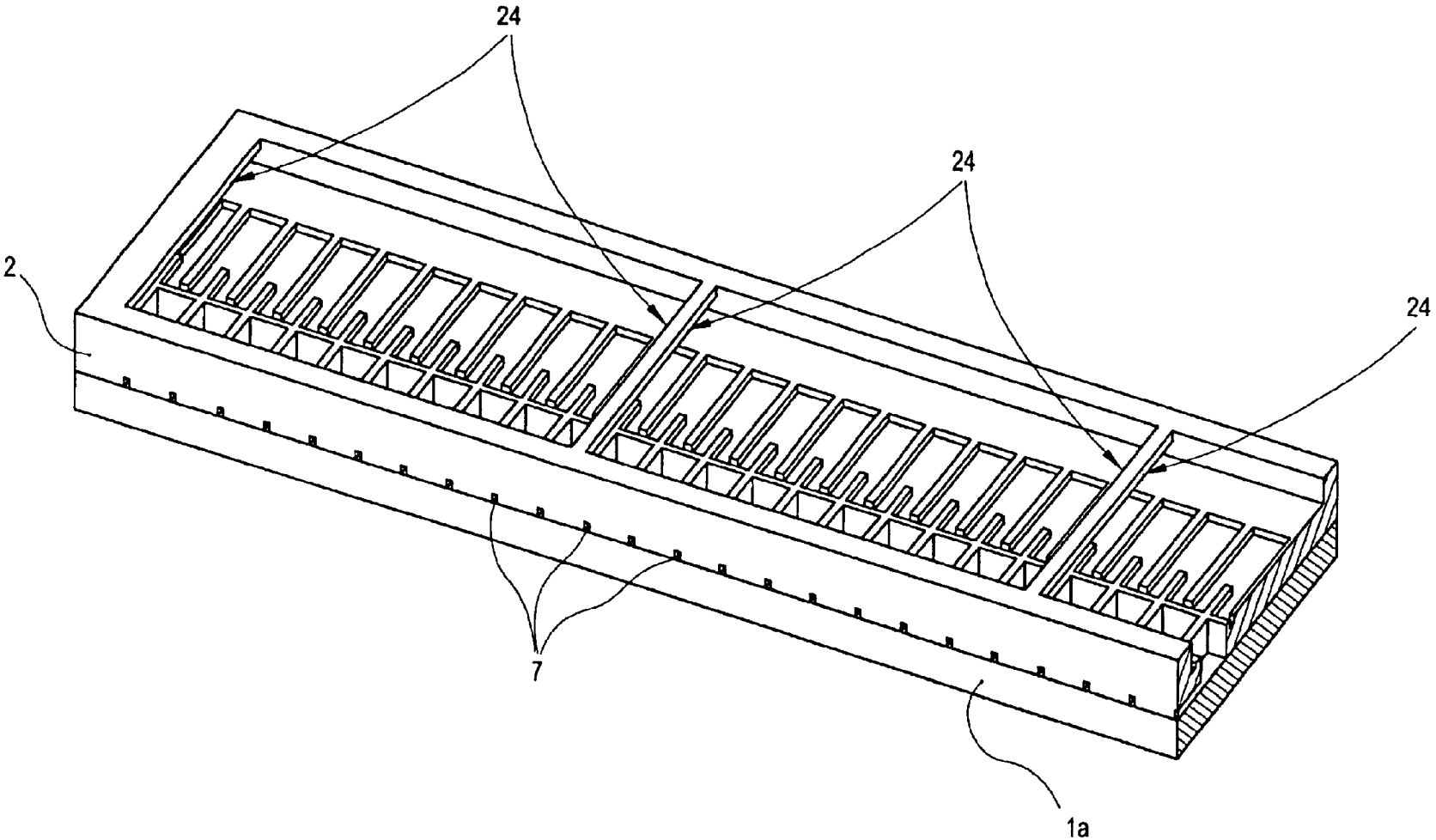

A protruding roll off face 22 having a width corresponding to a width of a web is formed in each case in the middle between two neighboring separating webs 21, reaching between the separating webs 21 and oppositely disposed as shown in FIG. 5A. An exiting of a pressure into the action region of a neighboring bending converter 1 can be further reduced, in principal, by such separating webs 21 in or on the frame plate 2. It is advantageous to form the separating webs 21 only in the region of the liquid chamber 13 and not to lead the separating webs 21 up to the bearing edge 4. This assures the liquid stream under the flexible fingers 5. A washable or flushable filling agent can be entered easily under the piezo plate 3 and can be removed again after a saw cut 23. The piezo plate 3 can be supported at the separating webs 21 during the adhesive attachment of the piezo plate 3 and prior to sawing, such that a precise distance measurement is achieved for the piezo plate 3.

A saw slot 23*a* is worked in between, in each case, two flexible fingers 5 during a production of the flexible fingers 5 through a saw cut. This occurs when the saw slot 23*a* corresponds in its width to the thickness of a chamber intermediate wall 8 or to the thickness of a separating web 21. The sawing of the piezo plate 3 in the plane of the separating webs 21 or of the chamber's intermediate wall 8 up to the height level (the start) of the separating webs 21, wherein the separating webs 21 are slightly sawed on, results in an exact coordination of the flexible fingers 5 to the liquid chamber 13 and to the separating webs 21. A sideways air gap can be generated during the sawing between the separating webs 21 and the edge of the piezo plate 3, such that the fluid upon actuation is not enclosed under the flexible finger 5, which dampens the motion. The flexible fingers 5 are by a minimal tolerance smaller as compared to the distance of the separating webs 21.

It will be understood that each of the elements described above, or two or more together, may also find a useful application in other types of droplet producing system configurations and liquid ink processing procedures differing from the types described above.

While the invention has been illustrated and described as embodied in the context of a droplet generator for microdroplets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

LIST OF REFERENCE NUMERALS

1. bending converter
1*a*. base plate
2. frame plate
3. piezo plate
3*a*. multilayer (passive)
3*b*. multilayer (active)
4. bearing edge
5. flexible finger
6. liquid droplet (microdroplet)
7. nozzle
8. chamber intermediate wall
9. connection barrier
10. bearing position
11. casing
12. liquid longitudinal channels
13. liquid chamber
14. opening
14*a*. width
15. edge bead
16. shaft
17. liquid inlet
18. liquid feed line
19. opening of the nozzle
20. nozzle plate
21. separating web
22. roll off face
23. saw cut
23*a*. saw slot

What is claimed is:

1. A droplet generator for microdroplets, in particular nozzle head for inkjet printers, comprising groups of piezo electrically actuated bending converters (1) disposed in a casing (11), wherein the bending converters (1) are disposed at a distance from each other, over a partial length of the bending converters are guided separately in recesses by wall thicknesses, wherein liquid longitudinal channels (12) are disposed under flexible fingers (5) in a frame plate (2) and running in longitudinal direction and wherein a liquid chamber (13) is formed in the frame plate (2), wherein at least one nozzle is connected to the liquid chamber (13) for each bending converter (1), wherein an edge bead (15) runs around an opening (14) of the liquid chamber (13), wherein the edge bead (15) serves to limit a stroke of a respective one of the flexible fingers (5), and wherein a shaft (16) forming part of the liquid chamber 13) follows to the opening (14) and reaches in height level up to a base plate (1*a*).

2. The droplet generator according to claim 1, wherein a common liquid inlet (17) is disposed in the casing (11) above the flexible fingers (5).

3. The droplet generator according to claim 1 wherein the liquid longitudinal channels (12) under the flexible fingers (5) are connected to a fluid feed line (18) running cross to the flexible fingers (5) in a region disposed away from the nozzles (7).

4. The droplet generator according to claim 1 wherein the liquid chamber (13) is continued in the frame plate (2) below the edge bead (15) with a width (14*a*) of the opening (14) and wherein the liquid chamber (13) extends at a right angle up to the opening (19) of the nozzle (7).

5. The droplet generator according to claim 1 wherein each nozzle (7) is disposed in a nozzle plate (20) placed onto the casing (11) and/or the frame plate (2) and/or the base plate (1*a*).

6. The droplet generator according to claim 1 wherein the nozzle plate (20) is disposed at a bottom side of a base plate (1*a*) while the nozzles (7) are running perpendicular through the base plate (1*a*).

7. The droplet generator according to claim 1, wherein a separating web (21) runs in the frame plate (2) at the edge bead (15).

8. The droplet generator according to claim 7 wherein the separating web (21) is connected between two side-by-side running edge beads (15).

9. The droplet generator according to claim 1 comprising a protruding roll off face (22) that is furnished in the middle between two neighboring separating webs (21), which roll off face (22) is reaching between the separating webs (21) and which roll off face (22) disposed oppositely directed relative to the separating webs (21).

10. The droplet generator according to claim 1, wherein a saw slot (23*a*) is worked in between two flexible fingers (5) formed during production by a saw cut (23), wherein the width of the saw slot (23*a*) corresponds to the thickness of the chamber's intermediate wall (8) or to the thickness of a separating web (21).

11. A droplet generator for microdroplets comprising a casing (11);

a frame plate (2) having a first side attached to the casing (11) and having a second side;

a base plate (1*a*) attached to the second side of the frame (2);

a plurality of walls (8);

a plurality of piezo electrically actuated bending converters (1) disposed in the casing (11), wherein the bending converters (1) are disposed at a distance from each other, over a partial length of the bending converters are guided separately by thicknesses of respective ones of the walls (8);

a plurality of longitudinal channels (12) for liquid flow are disposed under respective ones of the plurality of flexible fingers (5) in the frame plate (2) and running in longitudinal direction;

a plurality of liquid chambers (13) formed in the frame plate (2) and having a plurality of openings (14) with a plurality of edges, wherein the plurality of liquid chambers (13) includes a plurality of shafts (16) following to respective ones of the openings (14) and reaching in height level up to the base plate (1*a*);

a plurality of edge beads (15) running along respective ones of the plurality of edges, wherein the plurality of edge beads (15) serves to limit a stroke for respective ones of the plurality of the flexible fingers (5); and a plurality of nozzles connected to respective ones of the plurality of liquid chambers (13) for each respective one of the plurality of bending converters (1).

12. The droplet generator according to claim 11, wherein a common liquid inlet (17) is disposed in the casing (11) above the plurality of flexible fingers (5).

13. The droplet generator according to claim 11 wherein the plurality of liquid longitudinal channels (12) under the plurality of flexible fingers (5) are connected to a fluid feed line (18) running cross to the plurality of flexible fingers (5) in a region disposed away from the plurality of nozzles (7).

14. The droplet generator according to claim 11 wherein the plurality of liquid chambers (13) is continued in the frame plate (2) below respective ones of the plurality of edge beads (15) with a width (14*a*) of the individual ones of the plurality of openings (14) and wherein individual ones of the plurality of liquid chambers (13) extend at a right angle up to openings (19) of the plurality of nozzles (7).

15. The droplet generator according to claim 11 further comprising a nozzle plate placed onto the casing (11) and/or the frame plate (2) and/or the base plate (1*a*), wherein the plurality of nozzles (7) is disposed in the nozzle plate (20).

16. The droplet generator according to claim 11 wherein the nozzle plate (20) is disposed at the bottom side of the base plate (1*a*) while the plurality of nozzles (7) are running perpendicular through the base plate (1*a*).

17. The droplet generator according to claim 11 further comprising a plurality of separating webs (21) running in the frame plate (2) at the plurality of edge beads (15).

18. The droplet generator according to claim 17 wherein the plurality of separating webs (21) is connected in each case between two side-by-side running edge beads (15) out of the plurality of edge beads (15).

19. The droplet generator according to claim 11 further comprising a plurality of protruding roll off faces (22), wherein each one of the plurality of protruding roll off faces (22) is furnished in the middle between two neighboring separating webs (21) of the plurality of separating webs (21), wherein one of the plurality of roll off faces (22) is reaching between respective separating webs (21) of the plurality of separating webs (21) and wherein an individual one of the plurality of roll off faces (22) is disposed oppositely directed relative to respective ones of the plurality of separating webs (21).

20. The droplet generator according to claim 11, wherein a saw slot (23*a*) is worked in between in each case two neighboring ones of the plurality of flexible fingers (5) formed during production by a saw cut (23), in which the width of the saw slot (23*a*) corresponds to a thickness of intermediate walls (8) of a chamber or to a thickness of one of the plurality of separating webs (21).

21. A droplet generator for microdroplets comprising a casing (11);

a frame plate (2) having a first side attached to the casing (11) and having a second side;

a base plate (1*a*) attached to the second side of the frame plate (2);

a first wall (8);

a first piezo electrically actuated bending converter (1) disposed in the casing (11), and over a partial length of the first bending converter guided separately by the first wall (8);

a second piezo electrically actuated bending converter (1) disposed in the casing (11) and over a partial length of the second bending converter guided separately by the first wall (8), wherein the first bending converter (1) and the second bending converter (1) are disposed at a distance from each other;

a first flexible finger (5);

a second flexible finger (5);

a first longitudinal channel (12) for liquid flow disposed under the first flexible finger (5) in the frame plate (2) and running in longitudinal direction;

a second longitudinal channel (12) for liquid flow disposed under the second flexible finger (5) in the frame plate (2) and running in longitudinal direction;

a first liquid chamber (13) formed in the frame plate (2) and having a first opening (14) with a first plurality of edges, wherein the first liquid chambers includes a first shaft (16) following to the first opening (14) and reaching in height level up to the base plate (1*a*);

a second liquid chamber (13) formed in the frame plate (2) and having a second opening (14) with a second plurality of edges, wherein the second liquid chamber includes a second shaft (16) following to the second opening (14) and reaching in height level up to the base plate (1*a*);

a first plurality of edge beads (15) running along respective ones of the first plurality of edges, wherein the first plurality of edge beads (15) serves to limit a stroke of the first flexible finger (5);

a second plurality of edge beads (15) running along respective ones of the second plurality of edges, wherein the second plurality of edge beads (15) serves to limit a stroke of the second flexible finger (5);

a first nozzle connected to the first liquid chamber (13) for the first bending converter (1);

a second nozzle connected to the second liquid chamber (13) for the second bending converter (1).

* * * * *